United States Patent [19]

Angele et al.

[11] 4,144,825

[45] Mar. 20, 1979

[54] WORKPIECE STACKING DEVICE FOR SEWING MACHINES

[75] Inventors: Werner Angele; Hermann Welz, both of Au am Rhein, Fed. Rep. of Germany

[73] Assignee: Pfaff Industriemaschinen GmbH, Kaiserslautern, Fed. Rep. of Germany

[21] Appl. No.: 845,941

[22] Filed: Oct. 27, 1977

[30] Foreign Application Priority Data

Oct. 29, 1976 [DE] Fed. Rep. of Germany ..... 2649471

[51] Int. Cl.[2] ..... D05B 41/00

[52] U.S. Cl. ..... 112/121.29; 271/175

[58] Field of Search ..... 112/121.29, 121.15, 112/121.14, 121.12, 2; 271/175

[56] References Cited

U.S. PATENT DOCUMENTS

| | | | |
|---|---|---|---|
| 3,371,631 | 3/1968 | Rockwrath | 112/121.29 |
| 3,672,314 | 6/1972 | Firestein et al. | 112/121.29 |
| 3,701,328 | 10/1972 | Frost | 112/121.29 |
| 3,788,248 | 1/1974 | Marforio | 112/121.29 |
| 3,850,121 | 11/1974 | Speer | 112/121.29 |
| 4,067,272 | 1/1978 | Marforio | 112/121.29 |

FOREIGN PATENT DOCUMENTS

| | | | |
|---|---|---|---|
| 2312878 | 9/1974 | Fed. Rep. of Germany | 112/121.29 |
| 1439535 | 4/1966 | France | 112/121.29 |

*Primary Examiner*—Werner H. Schroeder
*Assistant Examiner*—Andrew M. Falik
*Attorney, Agent, or Firm*—McGlew and Tuttle

[57] ABSTRACT

A device for the removal of flexible workpieces which are draped over a workpiece holding arm and which hang downwardly from each side thereof, in particular, over a work-handling arm of an arm-down sewing machine, comprises a horizontally disposed carrying arm or rod which is adapted to receive the sewn material and support it so that portions hang downwardly from each side thereof. A material engagement clip, which has a pair of clamping arms arranged below the carrying arm, is mounted for movement in directions substantially parallel to the carrying arm in order to move the clamping arms on respective sides of the workpiece and subsequently to move the clamping arms together so that they clamp the workpiece and strip the workpiece from the carrying arm when the clamping arms are moved outwardly from the carrying arm.

6 Claims, 4 Drawing Figures

WORKPIECE STACKING DEVICE FOR SEWING MACHINES

FIELD AND BACKGROUND OF THE INVENTION

This invention relates in general to sewing machines and, in particular, to a new and useful device to remove flexible workpieces which are draped over a workpiece holding arm and hang downwardly from each side thereof, in particular, over a work-handling arm of an arm-down sewing machine, which includes a carrying rod disposed in a vertical plane parallel to the lengthwise direction of the workpiece holding arm and which accepts the workpieces which straddle it.

DESCRIPTION OF THE PRIOR ART

In order to obtain greater seam strength, seams formed on arm-down sewing machines, such as, the closing seams of underpants, are often provided at the seam ends with a lock-stitch seam on a lock-stitch machine. It is then advantageous to arrange the workpieces processed on the arm-down sewing machine in a stack on the lock-stitch machine so that the end of the workpieces on which the seams are to be made can be taken off the stack successively and fed to the stitch-forming point. This makes it easier to handle the workpieces quickly and results in good utilization of the machine.

The known stacking devices on sewing machines can usually only pick up workpieces which are spread out flat and, for this reason, they are unsuitable for machines with a work-holding arm, from which the workpieces hang down in disarray.

A stacking and bundling device for arm-down sewing machines is known from German Design Pat. No. 6,812,124 filed Dec. 12, 1963 and published Apr. 24, 1969. The device consists of a carrying rod extending parallel to the sewing machine feeding direction, with one of its ends being disposed at the face of the work-holding arm, and its other end disposed at a lower frame point. The workpieces, hanging from both sides of the sewing machine work-holding arm, while the seam is being formed, slide onto the carrying rod so as to straddle it as they leave the stitch-forming point, and slide along the carrying rod to a receiving panel where they form an irregular stack in an irregularly wavy and compressed condition.

SUMMARY OF THE INVENTION

The present invention provides a device for the uniform, spread-out stacking of workpieces provessed on machines with a work-holding arm, in particular, on arm-down sewing machines, in which the workpieces are taken off the work-holding arm in an oriented position and are then transferred into the horizontal position required for the stacking operation.

In accordance with the invention, the carrying rod is essentially horizontal and is cantilevered at its end opposite the work-holding arm and, in order to stack the workpieces on an essentially horizontal panel, a pull-off and depositing device is provided which performs a longitudinal motion in the carrying rod range parallel to the carrying rod and a transverse motion outside of the carrying rod range.

The carrying rod, aligned with the work-holding arm, effects a vertical orientation of the workpieces wherein, the workpieces, while being sewn on arm-down sewing machines, are pushed onto the carrying rod so as to straddle it, but in arm sewing machines, the workpieces are fed transversely to the fabric-carrying arm and are arranged on the carrying arm prior to the start of the sewing operation where they remain in their vertical orientation while being sewn. Since the carrying rod end opposite the work-holding arm is free, a workpiece hanging on it can be safely picked up by the pull-off and depositing device, according to the invention, and pulled off the carrying rod in a vertical orientation. During the subsequent relative motion performed by the pull-off and depositing device transverse to the carrying rod, the workpiece is transferred into the horizontal position required for stacking, in conjunction with the action of a guide blade formed either by the device or by the upper edge of the panel supporting the stack or by the stack itself.

According to a further suggestion of the invention, the pull-off and depositing device consists of a clip movable parallel to the carrying rod and a receiving plate movable back and forth below the clip between the clip and a panel receiving the stack. One edge of the receiving plate, which is parallel to the carrying rod, forms the guide blade for the workpieces. The motions of the clip and the receiving plate are performed in succession in that the clip first pulls a workpiece from the carrying rod, whereupon, the receiving plate moves underneath the workpiece hanging from the clip outside of the carrying rod range and, thereby, brings its hanging portion into a horizontal position. After opening the clip, the remainder of the workpiece also drops onto the receiving plate with the workpiece now being oriented so that the seam formed earlier and which may possibly require further processing at its ends, is always on a lateral workpiece edge.

Due to the feature of having the two motions of the pull-off and depositing device in different directions, performed by two separate components, movable independent of each other, namely, the clip and the receiving plate, the construction of the device according to the invention is simplified and affords the possibility of having the two motions overlap timewise, at least in part, thereby saving stacking time.

When using a vertically movable stacking table, it is further proposed to mount a pressure plate above the stacking table which can be lowered onto the receiving plate and which has a greater coefficient of friction than the receiving plate. The pressure plate, lowerable onto the receiving plate and thus onto the workpiece spread out flat on the plate, retains the workpiece during its motion in the clip direction, whereby, it is stripped off of the receiving plate and is consequently dropped onto the stacking table or onto the stack on the table.

In order that the workpiece will not be shifted during the stripping motion or pulled by the receiving plate relative to the pressure plate by a small amount, according to the invention, a clamp is disposed below the pressure plate and opposite the clip, and it is pivotable about a horizontal axis which penetrates a cutout provided in the receiving plate. This clamp expediently swings into an open position to release the workpiece only when the workpiece end, held between the pressure plate and the receiving plate moving in the clip direction, slips off of the receiving plate, or after it has slipped off of the plate and has dropped onto the stack. The clamp therefore ensures that the workpieces are stacked in a uniform position, spread out flat, and in edge-parallel alignment of their sewn end, in order to form a uniform stack. Such a careful orientation has the advantage that if the workpieces in the area of the seam formed earlier are processed further, they can be gripped on target by the operator without special attention and then they may be fed to the stitch-forming point of the sewing machine.

It is further proposed that the pressure plate be arranged so as to be lowerable to the stack. Through this measure, each stacked workpiece is pressed flat against the stack, which strengthens the stack overall, so that it stands upright without lateral support.

When using the device according to the invention in an arm-down sewing machine, a further advantageous embodiment is characterized in that a live conveyor belt running parallel to the rod, which is vertically shiftable, is disposed above the carrying rod. The conveyor belt, the speed of which is expediently matched to the sewing speed, promotes the sliding of the workpiece leaving the stitch-forming point of the sewing machine onto the carrying rod and thereby achieves a completely foldless arrangement of the workpiece on the carrying rod.

Accordingly, an object of the invention is to provide a device for the removal of flexible workpieces from the work-handling arm of a sewing machine, which includes a carrying arm over which the workpieces are fed so that each side hangs downwardly therefrom and a mterial engagement clip which is movable in directions substantially parallel to the longitudinal axis of the carrying arm and includes clamping arms for engaging the workpiece from respective opposite sides which are clamped together to hold the workpiece and strip it off the carrying arm, and which further includes a receiving table or plate which is moved at substantially right angles to the material engagement clip and is located at a fixed distance below the carrying arm so that it may be moved against a side of the workpiece to deflect the workpiece which is now held by the clamping arms into a horizontal position, whereupon, the arms release the material, and which further includes a clamping means for engaging the material on the receiving plate and for removing it into a horizontal stack, preferably, as the receiving plate is moved in respect to the material engagement clip.

Another object of the invention is to provide a device for transferring vertically arranged drape garments which are fed from a sewing machine from a vertical position into a horizontal position and then for depositing them in a horizontal position in a vertical stack.

A further object of the invention is to provide a workpiece stacking device for sewing machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 2:
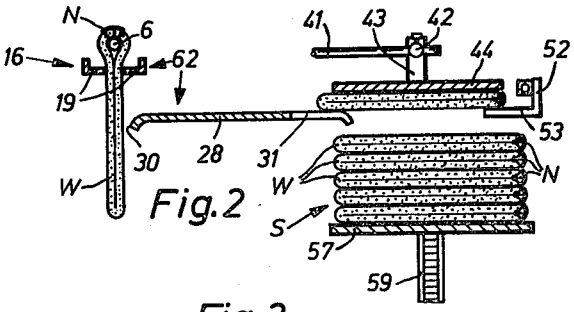
FIG. 2 is a sectional representation of the operating components of the device of FIG. 1, taken along the line II—II of FIG. 1.

Referring to the drawing in particular, the invention embodied therein, comprises a device for the removal of flexible workpieces W which are draped over a workpiece holding arm 4 and hang downwardly from each side thereof and, in particular, over a work-handling arm of an arm-down sewing machine, generally designated 1.

The stacking device of the invention is used on an arm-down sewing machine 1. Only the head 2 with the sewing foot 3 and the work-holding arm 4 of machine 1 are shown. A known thread-cutting device 5 is disposed in the area of the free end of the work-holding arm 4. A horizontal carrying rod 6, whose end 7 opposite from the work-holding arm 4 is cantilevered, is fastened to the free end of the work-holding arm 4 in line with its longitudinal direction. An angle 12 is movable vertically on a stationary stringer 8 of a frame 9 by means of two guide rods 10 and a compressed air cylinder 11. A conveyor belt 13 formed by a toothed belt, located above the carrying rod 6 and connected to a known, speed-controllable gear motor 14 is mounted to the angle 12.

A clip 16 is movably mounted on a guide rail 15 mounted to the frame 9. The clip 16 has a carriage 17 which is mounted on the guide rail 15 and on which are arranged two mutually intersecting, bent levers 18 which support a clamping strip 19 at their lower ends, each of which extend parallel to the carrying rod 6. An angular part 20, which supports a compressed air cylinder motor 21, is attached to the carriage 17. Two pull rods 23, 23, each of which is linked to the upper end of one of the two levers 18, are linked to the piston rod 22 of the compressed air cylinder 21. A compressed air cylinder motor 24 has a movable piston rod 21 which is connected to the angular part 20 of clip 16 and it is mounted on an upright 92 of the frame 9 parallel to the guide rail 15.

Figure 1:
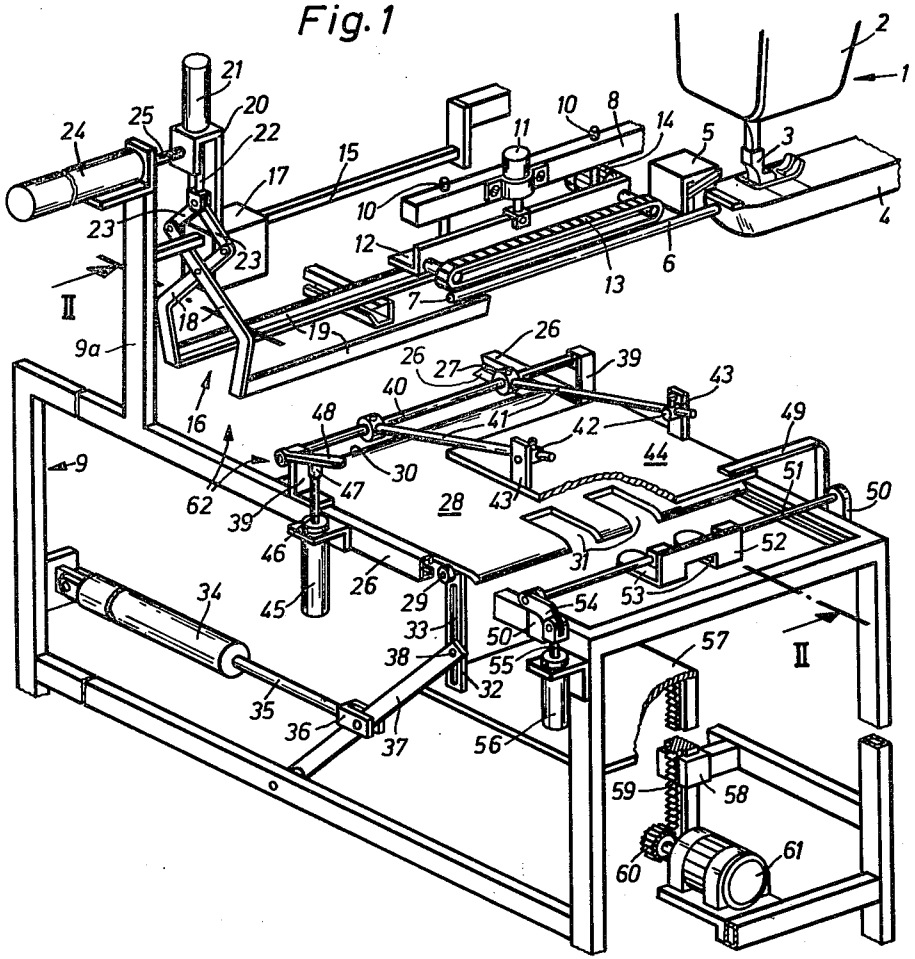
FIG. 1 is a perspective view of a stacking device used with a sewing machine, constructed in accordance with the invention.

The frame 9 has two horizontal tracks 26, 26, spaced a short distance below the clamping strips 19, which extend transverse to the carrying rod 6. The tracks are hollow and have longitudinal slots on their sides facing each other. A flat receiving plate 28 with a smooth surface and lateral rolls 29 running in the tracks 26 is disposed between the tracks. The edge of receiving plate 28 facing the clip 16 in FIGS. 1 and 2 defines the guide blade 30. In the area of the edge opposite the guide blade 30, the receiving plate 28 contains two cutouts 31. An arm 32 which is provided with an elongated slot 33 is fastened to the underside of the receiving plate 28. A compressed air cylinder motor 34, which has a piston rod 35 carrying a forked head 36, is pivoted to the frame 9. Forked head 36 is linked to a drive arm 37 which is pivoted on the frame 9 and has a bolt 38 which engages the elongated slot 33.

Two angles 39 which support a shaft 40 extending parallel to the carrying rod 6 are fastened to the tracks 26. Two rods 41 are mounted on shaft 40 so as to be mutually parallel and to support rotatably by means of adjustable pivot pins 42, a pressure plate 44 having two brackets 43. A compressed air cylinder 45, whose piston rod 46 supports a plunger 47, is attached to one of the two tracks 26. The plunger 47 interacts with an arm 48 mounted to shaft 40. An angle stop 49 fastened to frame 9 limits the counterclockwise pivoting motion of the pressure plate 44 in its position raised by the compressed air cylinder 45. The underside of the pressure plate 44 is roughened or provided with an anti-slide coating so that its coefficient of friction is greater than that of the top of the receiving plate 28.

A shaft 51 to which are fastened by a clamping yoke having two clamps 53 by means of a carrier plate 52 is mounted in two brackets 50 attached to the two tracks 26. In the operating position shown in FIGS. 1 to 3, the two clamps 53 are in the plane of the receiving plate 28 and project into the latter's cutouts 31 when in its end position. A lever 54 which is linked to the piston rod 55 of a compressed air cylinder motor 56, mounted to frame 9, is attached to shaft 51.

A stacking table 57 which is mounted to a rack 59 accommodated in a stationary guide bushing 58 is located underneath the pressure plate 44. A pinion 60, driven by a gear motor 61, meshes with the rack 59.

The clip 16, together with the receiving plate 28, form a pull-off and depositing device 62 which, in the range of the carrying rod 6, performs a longitudinal motion parallel to the latter and, outside of the range of the carrying rod 6, performs a transverse motion.

Figure 3:
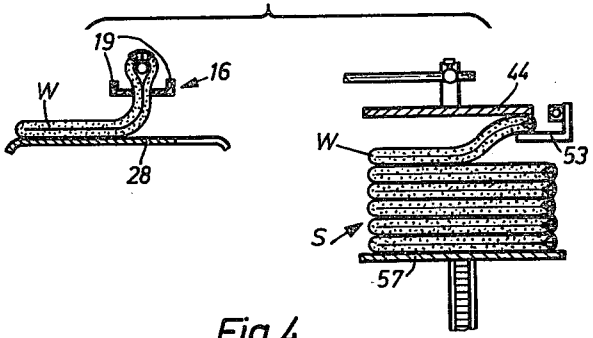
FIGS. 3 and 4 are views similar to FIG. 2 showing the parts in different operating positions.
Figure 4:
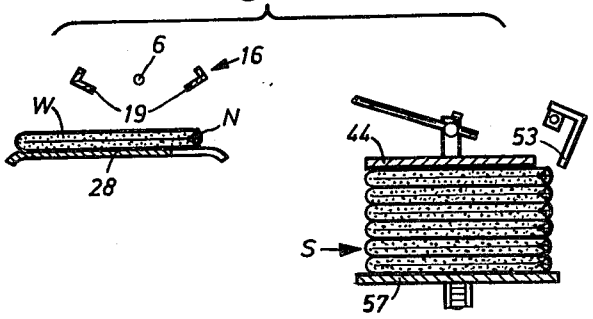

As shown in FIGS. 2, 3 and 4, the stacking device operates as follows:

When sewing a workpiece W on the arm-down sewing machine 1, two ends of the workpiece W are placed on top of each other on the work-holding arm 4 and are joined to each other by a multiple-thread closing seam N. In this process, the part of the workpiece W which has already been sewn emerges from under the sewing foot 3 and slides between the carrying rod 6 and the revolving, lowered conveyor belt 13, with the seam N of the workpiece W lying on top of the carrying rod 6. If the revolving speed of the conveyor belt 13 matches the sewing speed, the workpiece W is pulled over the carrying rod 6 from which it hangs down in vertical orientation without throwing folds. As soon as the seam N is completed on the workpiece W and the entire workpiece W is on the carrying rod 6, the threads are cut by the thread cutter 5.

While a workpiece W is being pushed over the carrying rod 6, the opened clip 16 is moved in the direction of the work-holding arm 4 by the compressed air cylinder 24. This makes it possible to close the clip 16 immediately after the actuation of the thread cutter 5 by jointly pivoting the levers 18 by the compressed air cylinder motor 21, and the clamping strips 19 are moved toward each other. After the clip 16 has closed the conveyor belt 13, it is lifted off of the workpiece W and the carrying rod 6, first by means of the compressed air cylinder 11 and the clip 16, and is subsequently moved on the guide rail 15 by the compressed air cylinder 24, with the workpiece W, clamped by the clamping strips 19 below the carrying rod 6, being pulled off the carrying rod 6.

Thereupon, the receiving plate 28 is moved in the direction of the clip 16 by means of the compressed air cylinder 34 and the drive arm 37, the guide blade 30 of the receiving plate 28 transferring the part of the workpiece W hanging from the clip 16 into a horizontal position in that this part of workpiece W deposits itself flat on top of the receiving plate 28, as shown in FIG. 3. The clip 16 is then opened by means of the compressed air cylinder motor 21, whereupon, the part of the workpiece W hitherto retained by the clamping strips 19 deposits itself flat on the receiving plate 28. In this process, the seam N, formed earlier, is on the workpiece edge and faces the cutouts 31 in the receiving plate 28, which edge is hereinafter called the seam end. Since in this position, the receiving plate 28 always assumes the same position relative to the clip 16, the seam end of the workpiece W is always spaced the same distance apart from the edge of the receiving plate 28 facing the clamps 53.

Immediately upon opening the clip 16, the receiving plate 28, with the workpiece W lying flat on top of it, is moved out of the range of clip 16 by means of the compressed air cylinder 34 and is pushed past the raised pressure plate 44 into the other end position in which the two clamps 53 under the seam end of workpiece W engage the cutouts 31 in the receiving plate 28. After the latter has reached this end position, the piston rod 46 of the compressed air cylinder motor 45 is retracted, causing pressure plate 44 to lower itself by its own weight onto workpiece W thereby pushing it against the receiving plate 28 and against the clamps 53.

As soon as pressure plate 44 rests on workpiece W, the compressed air cylinder 34 is reversed, which causes receiving plate 28 to move in the direction of the clip 16 again. During this motion, workpiece W, lying on top of receiving plate 28, is held back by both the interaction of pressure plate 44 with clamps 53 and the greater coefficient of friction of the pressure plate 44 so that it is stripped off of the carrying rod 6, as shown in FIG. 2. Clamps 53 remain in their operating position, shown in FIGS. 2 and 3, until the end of workpiece W, held between the pressure plate 44 and receiving plate 28, moving in the direction of clip 16, slides off of the receiving plate 28 or, as shown in FIG. 3, has already slipped off of it and dropped onto the stack S. It is only thereafter that the clamps 53 are pivoted into their open position, shown in FIG. 4, by means of the compressed air cylinder 56. This releases the seam end of workpiece W so that the rest of workpiece W now also drops onto stack S. At the same time, pressure plate 44 is also lowered, pressing the just-stacked workpiece W against the stack S, and compressing the stack so that it stands upright on the stacking table 57 without lateral support. The only condition for this second down motion of the pressure plate 44 is that the piston rod 46 of the compressed air cylinder motor 45 be retracted far enough.

During the particular time span of a stacking operation in which receiving plate 28 with a workpiece W moves into the end position near the clamps 53, and the pressure plate 44 is lowered, open clip 16 moves in the direction of workholding arm 4, grips the next sewn workpiece W, in a manner already described, and pulls it off of the carrying rod 6. In this way, the next workpiece W already hangs in clip 16 when receiving plate 28 is pulled from under the first workpiece W, and is retained by pressure plate 44 and clamps 53 so that, in the further course of the shifting motion of the receiving plate 28, the workpiece W, hanging from the clip 16, is deflected in a manner already described and shown in FIG. 3 and is deposited on the receiving plate 28. Before receiving plate 28 with the new workpiece W is again moved in the direction of clamps 53, the pressure plate 44, still resting on stack S, is raised into its upper position, shown in FIG. 1, by compressed air cylinder motor 45, and the clamps 53 are pivoted back into their operating position by the compressed air cylinder 56.

The following measures are decisive for the execution and the result of the stacking operation with the stacking device:

The carrying rod 6 effects a vertical orientation of the workpieces. The edge of the receiving plate 28, opposite the guide blade 30, in the end position of the receiving plate 28 near the clip 16, as shown in FIG. 4, always has the same horizontal spacing from clip 16, so that the seam end of the workpiece W is also always an equal distance apart from the edge of the receiving plate 28 after opening the clip 16. When the workpieces W are pulled off of receiving plate 28, pressure plate 44 and clamps 53 ensure that workpieces W are not distorted or pulled along. The stacking table 57 is always lowered far enough by the motor 61 so that the vertical distance between the uppermost workpiece W of the stack S and the receiving plate 28 is always essentially the same.

It is through these measures that the workpieces W are stacked in evenly spreadout position and in edge-parallel orientation of the seam end to form a uniform stack S.

While a specific embodiment of the invention has been shown and described in detail to illustrate the application of the principles of the invention, it will be understood that the invention may be embodied otherwise without departing from such principles.

What is claimed is:

1. A device for the removal of flexible workpieces which are draped over a workpiece holding arm and hang downwardly from each side thereof, in particular, over a work-handling arm of an arm-down sewing machine, comprising a carrying arm adapted to receive the sewn material and support it so that portions hang downwardly from each side of said carrying arm, a material-engagement clip having a pair of clamping arms located below said carrying arm, means mounting said clip for movement in directions substantially parallel to said carrying arm to move said clamp arms on respective sides of the workpiece, clamp arm actuating means connected to said clamp arms to close said clamp arms for engaging the workpiece from the respective opposite sides below said carrying arm to move with said clip to withdraw the workpiece from said carrying arm and also to open said clamping arms to release the workpiece, a workpiece receiving plate disposed below said carrying arms, means mounting said receiving plate for movement to a position below said clip when said clamping arms are withdrawn from said carrying arm to engage the workpiece sides and to deflect it onto said receiving plate into a horizontal position and for movement of said receiving plate away from said clip with the workpiece, and clamp means engageable with the workpiece on said receiving plate to remove it from said receiving plate and deposit it into a vertical stack.

2. A device according to claim 1, wherein said receiving plate includes an edge with a slot thereon, a clamp member disposed to engage in the edge of said receiving plate and a pressure plate movable downwardly to engage the workpiece and to press it against said clamp member, said clamp member with said pressure plate being effective to hold the workpiece and strip it from said receiving plate as it moves backwardly in a direction toward said clamp arms.

3. A device according to claim 1, including a stacking table, means for moving said stacking table upwardly and downwardly in respect to said receiving plate, said stacking table being located below said receiving plate and being advanced upwardly toward said receiving plate so as to maintain a height of a stack of workpieces deposited thereon at a constant level, said clamp means including a pressure plate, means mounting said pressure plate for movement to lower it toward said receiving plate for engagement of the workpiece thereon, said pressure plate having a friction greater than the receiving plate so that it engages the material and strips it from said receiving plate and deflects it onto said stacking plate when said receiving plate is moved away from said pressure plate.

4. A device according to claim 3, including a clamping yoke, means mounting said clamping yoke for pivotal movement about a horizontal axis, said pressure plate having an end adjacent said clamping yoke with a cutout portion, said clamping yoke being engageable through said cutout portion to clamp a workpiece with said pressure plate when said receiving plate is located adjacent said clamping yoke.

5. A device according to claim 4, including means mounting said pressure plate for movement so that it may be lowered onto said stacking plate.

6. A device according to claim 1, including a sewing machine work-holding arm connected to said carrying arm and conveyor belt means associated with said carrying arm for feeding material rom said holding-arm along said carrying arm.

* * * * *